US008424608B1

(12) United States Patent
Lugo et al.

(10) Patent No.: US 8,424,608 B1
(45) Date of Patent: Apr. 23, 2013

(54) SYSTEM AND METHOD FOR REMEDIATING HYDRATES

(75) Inventors: Mario R. Lugo, Houston, TX (US); Randolph G. Smith, Houston, TX (US); Scott A. Sorensen, Houston, TX (US)

(73) Assignee: Trendsetter Engineering, Inc., Houston, TX (US)

( * ) Notice: Subject to any disclaimer, the term of this patent is extended or adjusted under 35 U.S.C. 154(b) by 335 days.

(21) Appl. No.: 12/851,125

(22) Filed: Aug. 5, 2010

(51) Int. Cl.
*E21B 36/00* (2006.01)

(52) U.S. Cl.
USPC ..... 166/357; 166/338; 166/344; 166/302; 166/304; 166/57; 432/29; 432/221

(58) Field of Classification Search ..... 166/357, 166/338, 341, 344, 346, 351, 302–304, 57–61, 166/75.12; 432/29, 30, 219, 221, 222
See application file for complete search history.

(56) References Cited

U.S. PATENT DOCUMENTS

| | | | | |
|---|---|---|---|---|
| 2,639,774 | A * | 5/1953 | Rhoads | 166/57 |
| 2,911,047 | A * | 11/1959 | Henderson | 166/61 |
| 3,908,763 | A * | 9/1975 | Chapman | 166/302 |
| 4,378,846 | A * | 4/1983 | Brock | 166/303 |
| 4,679,598 | A * | 7/1987 | Jee | 138/103 |
| 5,641,022 | A * | 6/1997 | King | 166/303 |
| 5,803,161 | A | 9/1998 | Wahle et al. | |
| 6,260,615 | B1 | 7/2001 | Dalrymple et al. | |
| 6,415,868 | B1 * | 7/2002 | Janoff et al. | 166/368 |
| 6,756,021 | B2 * | 6/2004 | Botrel | 422/184.1 |
| 6,776,188 | B1 * | 8/2004 | Rajewski | 137/624.13 |
| 6,776,227 | B2 * | 8/2004 | Beida et al. | 166/61 |
| 6,889,770 | B2 * | 5/2005 | Qvam et al. | 166/356 |
| 6,939,082 | B1 * | 9/2005 | Baugh | 405/145 |
| 6,955,221 | B2 * | 10/2005 | Bursaux | 166/303 |
| 7,036,596 | B2 * | 5/2006 | Reid | 166/302 |
| 7,037,105 | B2 * | 5/2006 | Hayes | 432/63 |
| 7,234,523 | B2 * | 6/2007 | Reid | 166/302 |
| 7,669,659 | B1 * | 3/2010 | Lugo | 166/345 |
| 7,721,807 | B2 * | 5/2010 | Stoisits et al. | 166/366 |
| 8,006,763 | B2 * | 8/2011 | Bath et al. | 166/338 |
| 8,220,552 | B2 * | 7/2012 | Kinnari et al. | 166/367 |
| 2010/0044053 | A1 * | 2/2010 | Grimseth et al. | 166/369 |
| 2010/0051279 | A1 * | 3/2010 | Baugh et al. | 166/302 |
| 2010/0200231 | A1 * | 8/2010 | Minnich | 166/272.3 |
| 2010/0300486 | A1 * | 12/2010 | Hoffman et al. | 134/8 |

* cited by examiner

*Primary Examiner* — Matthew Buck
(74) *Attorney, Agent, or Firm* — Egbert Law Offices, PLLC

(57) ABSTRACT

A system for remediating hydrates has a heat storage box with an interior volume, a heater for heating fluid flowing into the hot fluid inlet of the heat storage box, a heat exchanger positioned in the interior volume of the heat storage box so as to be in heat exchange relationship with heated water from the interior volume of the heat storage box, and a line connected to a heated water outlet of the heat exchanger so as to be manipulated toward a location of the hydrates for the purpose of delivering the heated water toward the hydrates. The heat exchanger is piping extends in a serpentine pattern within an upper portion of the heat storage box. The line can be connected to a hot stab suitable for a manipulation by an ROV.

14 Claims, 2 Drawing Sheets

SYSTEM AND METHOD FOR REMEDIATING HYDRATES

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to subsea hydrocarbon production. More particularly, the present invention the relates to systems and methods for remediating solid hydrates that may accumulate in a subsea location associated with the hyrdrocarbon production. Additionally, the present invention relates to systems whereby heated water can be delivered from a subsea location to an area of the accumulated hydrates.

2. Description of Related Art Including Information Disclosed Under 37 CFR 1.97 and 37 CFR 1.98

There is often a need for heat to be delivered to a subsea location. In particular, in the offshore oil and gas industry, it is important to be able to supply heat to a desired location. Under certain circumstances, oil and gas wells are in locations in which presssure and temperature conditions cause the gases to form a solid hydrate. The hydrates are basically methane- or hyrdrocarbon-type ice. Hydrates are likely to form under conditions of high pressures and low temperatures. Although hydrates may form at any water depth, hydrate formation occurs most commonly in deep water. For example, at about one-thousand feet and below, the water temperature remains relatively constant, just slightly above freezing in the vast majority of the world's oceans. The pressure, however, dramatically increases with depth. This affects hydrate formation. In general, the deeper the water, the more critical the problem hydrates become for oil company operations. Typically, hydrate formation becomes an issue at approximately 1500 feet. Below 3000 feet, such hydrate formations present serious problems for the oil and gas companies.

The solid hydrate can form a blockage within a pipeline and can severely reduce or completely block the product flow of oil and/or gas. Hydrate formations also occur at other locations, for example, externally on a subsea wellhead. Hydrates have also been formed externally on the connector on the subsea wellhead and the lower marine riser package. This can result in frozen latches that prevent the connector from releasing.

In the past, companies have attempted to address the hydrate issue by installing hydrate traps in their pipelines. The hydrate trap is basically a loop inside of a pipeline that is specific to hydrate remediation. The installed hydrates trap is intended to generate the heat to remediate the hydrates plugs or ice. However, hydrate formation is problem for existing subsea pipelines having no hydrate traps as well as for subsea wellheads and associated equipment mounted thereon.

In the past, attempts have been made in an effort to apply heat to the hydrate formation. When heat is applied in an uncontrolled manner, there is a possibility that the heated hydrates could expand to the extent that a pressurized pipe could burst. Additionally, those prior attempts have been unable to store heat while the heat source is being re-energized. As such, a need has developed to be able to modulate the heat source so as to adapt to the particular hydrate formation. Additionally, there is a need to be able to store heat while the heat source is being energized.

Typically, when working in the subsea environment at significant depths, remotely-operated vehicles (ROVs) are used. ROVs are typically hydraulic-operated. In the past, attempts have been made at subsea hydrate remediation with the use of electric heaters powered by an ROV system. Unfortunately, typical ROV systems do not have sufficient electrical power to generate the heat necessary to effectively remediate such formations.

As such, it is desirable to provide a system and method for performing subsea hydrate remediation by using heat. It is also desirable to have a system and method for performing such hydrate remediation by using heat produced in a subsea location. It is further desirable to have a system and method for performing subsea hydrate remediation that can be delivered to a desired location by an ROV.

In the past, various patents have issued relating to such hydrate remediation activities. For example, U.S. Pat. No. 7,234,523, issued on Jun. 27, 2007 to B. J. Reid, describes a hydraulic friction fluid heater. This method includes pumping a fluid through a length of tubing such that the temperature of the fluid increases. The temperature increase of the fluid is created by friction in the tubing. It can also be created by at least one pressure reducing device, such as an orifice, a pressure reducing valve, or relief valve. A subsea structure may be heated by transferring heat from fluid circulating in a closed loop configuration or by direct application of fluid to the subsea structure by using a nozzle. A remotely operated vehicle may be utilized to transport some or all of the equipment necessary and to provide power to the pumps used for circulating fluid through the tubing.

U.S. Pat. No. 6,939,082, issued on Sep. 6, 2005 to B. F. Baugh, provides a subea pipeline blockage remediation method. This method involves the use of a remotely-operated vehicle on the ocean floor to land on and move along a subsea pipeline located above the seafloor. Electrically heated seawater is repeatedly circulated across the outer surface of the pipeline to melt hydrates which have formed on the inside of the pipeline.

U.S. Pat. No. 6,415,868, issued on Jul. 9, 2002 to Janoff et al., teaches a method and apparatus for preventing the formation of alkane hydrates in subsea equipment. This apparatus has at least one flow path through which a well fluid is permitted to flow. The well fluid has a flow temperature and a lower hydrate formation temperature at which hydrates will form in the well fluid. A temperature control device is provided which comprises a housing positioned in heat exchange relationship with respect to the flow path and a phase change material disposed in the housing. The phase change material has a melting point which is below the flow temperature but above the hydrate formation temperature. When the temperature of the phase change material drops to its melting point, the phase change material will solidify and its latent heat will be transferred to the well fluid to maintain the temperature of the well fluid in the flow path above its hydrate formation temperature.

U.S. Pat. No. 5,803,161, issued on Sep. 8, 1998 to Wahle et al., provides a heat pipe heat exchanger for cooling or heating high temperature/high-pressure sub-sea well streams. This heat exchanger has an annular reservoir surrounding a section of pipeline adjacent the wellhead. One or more heat pipes extend from the annular reservoir into the seawater. In a heat removal configuration, a working fluid is contained within the annular reservoir. The working fluid boils and is evaporated by heat from the wellstream fluid and forms a vapor which rises upwardly into and is condensed within the heat pipes so as to release heat into the surrounding seawater. The recondensed working fluid flows back down into the reservoir to repeat the cycle. In a heat-providing configuration, the working fluid is contained in the heat pipes so as to be boiled by heat transferred from the surrounding seawater. The resulting vapor rises upwardly into the annular reservoir and the heat is transferred to the cooler wellstream fluids.

U.S. Pat. No. 6,776,227, issued on Aug. 17, 2004 to Beida et al., discloses a wellhead heating apparatus and method which serves to prevent freeze-off of wellhead equipment. Radiant heat from a flameless heater is utilized to heat fluid in a heat exchanger, such as a tank or finned radiator. A pump is used to circulate the heated fluid through a conduit loop deployed in thermal contact with the equipment to be heated, such that the heat from the fluid is transferred to the equipment. The equipment is maintained it at sufficient temperature to prevent freeze-off.

U.S. Pat. No. 6,260,615, issued on Jul. 17, 2001 to Dalrymple et al., shows a method and apparatus for de-icing oilwells. A power cable is used for heating well bores in cold climates. An electrical switch is located within a wellbore at a selected location in the power cable. The electrical switch is provided to selectively short out the conductors within the power cable so as to allow the power cable above the switch to be used as a resistive heating element to thaw the wellbore.

U.S. Pat. No. 7,036,596, issued on May 2, 2006 B. J. Reid, provides a hydraulic friction fluid heater and method. The method includes pumping a fluid through a length of tubing such that the temperature of the fluid increases. The temperature increase of the fluid is created by friction in the tubing. A subsea structure may be heated by transferring heat from fluid circulating in a closed loop configuration or by direct application of fluid to the subsea structure using a nozzle. A remotely operated vehicle may be utilized to transport the equipment necessary.

U.S. Pat. No. 7,669,659, issued on Mar. 2, 2010 to M. R. Lugo, teaches a system for preventing hydrate formation in chemical injection piping for subsea hydrocarbon production. This system has a manifold, a production piping communicating with the manifold, a chemical injection line positioned in heat exchange relationship along the production piping, and a fluid delivery system connected to the chemical injection line for passing a heated fluid through at least a portion of the chemical injection line. The chemical injection line has a first portion affixed to a surface of the production piping and a second portion extending outwardly therefrom. The fluid delivery system is in communication with the second portion of the chemical injection line. The chemical injection line extends in a U-shaped pattern or in a spiral pattern around an outer surface of the production piping.

It is an object of the present invention to provide a system and method for preventing hydrate formation in subsea locations.

It is another object of the present invention to provide a system and method for preventing hydrate formations in which the heated water is delivered from a subsea location.

It is another object of the present invention to provide a system and method for preventing hydrate formations whereby the heated water can be delivered to a desired location through the use of a ROV.

It is another object of the present invention to provide a system and a method for preventing hydrate formations that can be modulated to the particular hydrate formation.

It is a further object of the present invention to provide a system and a method for preventing hydrate formations that can store heat while the system is being energized.

It is still a further object of the present invention to provide a system and method for preventing hydrate formations which is easy to use, relatively inexpensive, and easy to manufacture.

These and other objects and advantages of the present invention will become apparent from a reading of the attached specification and appended claims.

BRIEF SUMMARY OF THE INVENTION

The present invention is a system for remediating hydrates comprising a heat storage box with an interior volume, a heating means for heating fluid flowing into the hot fluid inlet of the heat storage box, a heat exchanger positioned in the interior volume of the heat storage box, and a line connected to a heated water outlet of the heat exchanger. The heat exchanger has an upper portion and a lower portion. This heat storage box also has a hot fluid inlet and a cold water outlet. The heat exchanger has a cold water inlet and a heated water outlet. The heat exchanger is in heat exchange relationship with heated water within the interior volume of the heat storage box. The line is suitable for manipulation toward a location of the hydrate so as to deliver the heated water toward the hydrates.

In the system of the present invention, the heat exchanger is positioned in the upper portion of the heat storage box. The heat storage box has insulated walls extending therearound.

In the present invention, the heating means is a chamber having a water inlet and a heat source arranged such that the heat source elevates a temperature of the water in the chamber. The heat source is mixture of pressurized fuel and compressed air and a means for igniting the mixture. The pressurized fuel is received within a first tank positioned on the skid. The compressed air is received within the second tank positioned on the skid. The first and second tanks are connected to the chamber by conduits extending from the skid.

The hot fluid inlet extends through a top of the heat storage box so as to open to the upper portion of the interior volume. The cold water outlet extends through a bottom of the heat storage box and opens to the lower portion of the heat storage box. A gas vent extends through a wall of the heat storage box and has an end opening to the upper portion of the interior volume. This gas vent is suitable for releasing a gas from the interior volume.

The heat exchanger comprises a piping extending in a serpentine pattern within the open portion of the interior volume of the heat storage box. This piping defines a plurality of flow sections. A manifold pipe communicates with the heated water outlet. The manifold pipe is connected by separate valve respectively to the plurality of flow sections of the piping. The valves are selectively openable and closable. The valves are arranged in vertically spaced relationship to each other within the interior volume of the heat storage box.

A hot stab is provided that is suitable for a manipulation by an ROV. The hot stab is connected to the line. A hydrate mediation blanket has an inlet suitable for connection to the line so as to allow the heated water from the line to pass thereinto. The hydrate mediation blanket has a surface connected to the inlet so as to allow the heated water to be distributed along the surface. The surface of the hydrate mediation blanket is suitably flexible so as to be positionable over an area requiring the hydrate remediation. Alternatively, a wand can be connected to the line. This wand has an outlet suitable for allowing the heated water to be passed outwardly therefrom.

The present invention is also a method for remediating hydrates comprising the steps of: (1) heating cold water to an elevated temperature; (2) passing the heated cold water into a heat storage box such that hot water or steam resides within interior volume of the heat storage box; (3) delivering cold water through the hot water or steam in heat exchange relationship therewith so as to raise a temperature of the delivered cold water; and (4) directing the raised temperature water to a desired location of the hydrates.

In this method, the step of heating comprises: (1) mixing pressurized fuel and compressed air; (2) igniting the mixture of the pressurized fuel and compressed air; and (3) passing seawater in heat exchange relationship with the ignited mixture.

In this method, the heat exchange piping is positioned in an upper portion of the heat storage box. The plurality of flow sections of the heat exchange piping is connected through valves to a manifold pipe. This manifold pipe is connected to an outlet of the heat exchange piping. The valve can be selectively opened or closed so as to allow the raised temperature water to flow to the desired location. The raised temperature water can be flowed through a line connected to a hot stab. This hot stab can be manipulated so as to move to a hydrate remediation blanket. The raised temperature water is introduced into the hydrate remediation blanket so as to cause the raised temperature water to flow along a surface of the hydrate remediation blanket.

Alternatively, the step of directing includes flowing the raised temperature water through a line connected to a wand. The wand has an outlet. The wand is manipulated such that an outlet thereof is positioned in proximity to the location of the hydrates. The raised temperature water is discharged through the outlet to the location of the hydrates.

The heat storage box can be positioned in a subsea location. Similarly, a tank of the pressurized fluid can be placed on a skid. The tank of the compressed air can also be placed on the skid. The skid can then be lowered the subsea location.

DETAILED DESCRIPTION OF THE INVENTION

Figure 1:
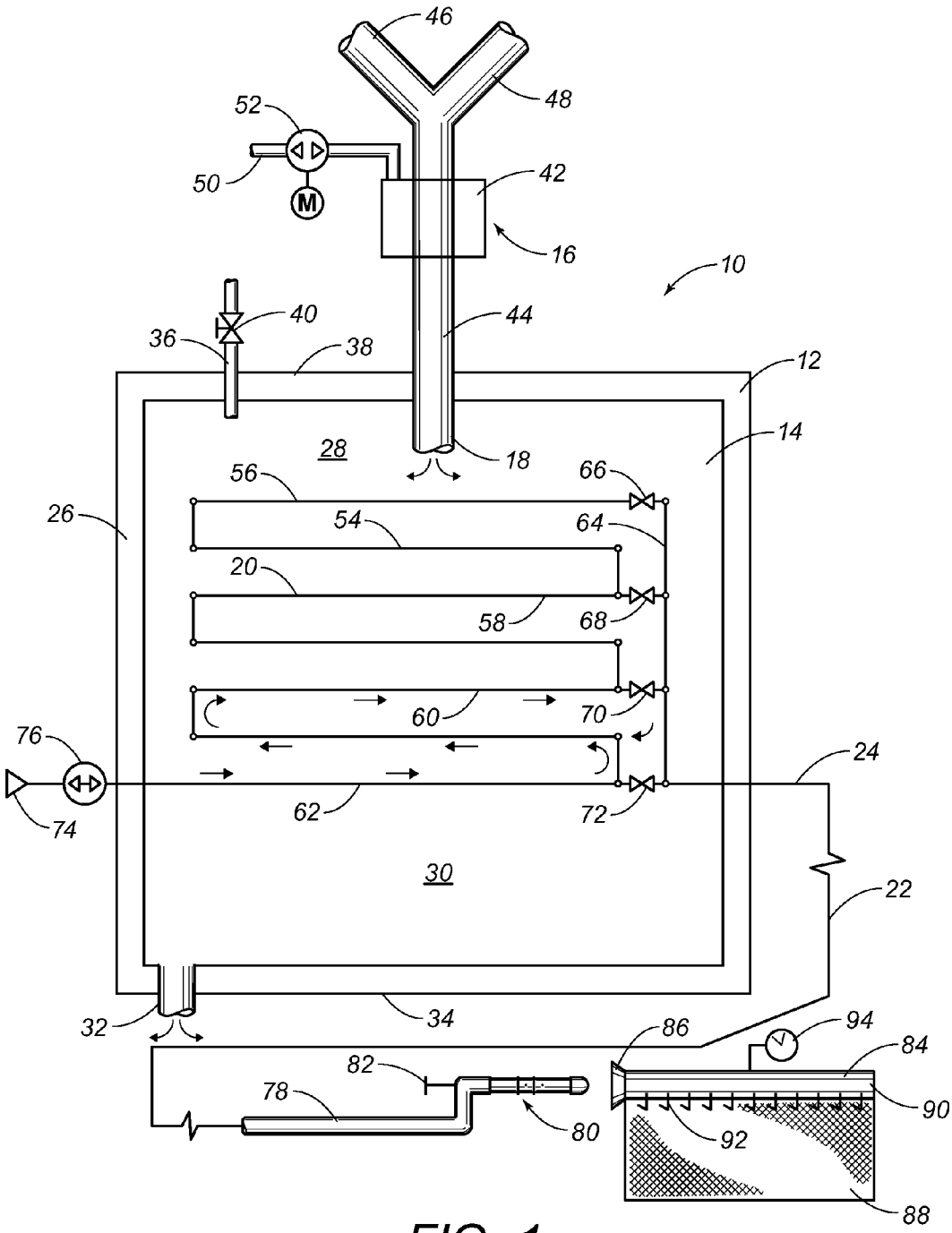
FIG. 1 is a diagrammatic illustration of the hydrate remediation system of the present invention.

Referring to FIG. 1, there is shown the system 10 for the remediation of hydrates in a subsea location. The system 10 includes a heat storage box 12 having an interior volume 14, a heating system 16 suitable for heating fluid flowing into a hot fluid inlet 18 of the heat storage box 12, a heat exchanger 20 positioned in the interior volume 14 of the heat storage box 12 and a line 22 connected to a heated water outlet 24 of the heat exchanger 20.

The heat storage box 12 has a plurality of insulated walls 26 extending therearound. The insulated walls 26 should have a quality suitable for maintaining the interior volume 14 in a heat insulated relationship to the surrounding seawater. The heat storage box 12 has an upper portion 28 and a lower portion 30 in the interior volume 14. The hot fluid inlet 18 opens to the upper portion 28 of the interior volume 14. A cold water outlet 32 opens to the lower portion 30 of the interior volume 14 and outwardly of the bottom 34 of the heat storage box 12. A gas vent 36 extends through the upper wall 38 of the heat storage box 12 and opens to the upper portion 28 of the interior volume 14. The gas vent 36 includes a valve 40 thereon. The gas vent 36 is suitable for allowing gases to be released selectively from the interior volume 14 of the heat storage box 12. The heating means 16 includes a chamber 42 mountable on the pipe 44 extending to the hot fluid inlet 18. A pressurized fuel supply line 46 is communication with the pipe 44. Similarly, a compressed air conduit 48 is also in communication with the pipe 44. Seawater is delivered into the chamber 42 through a pipe 50. A pump 52 is connected along the pipe 50 so as to control the flow of the seawater toward the hot fluid inlet 18.

The chamber 16 is in the nature of a "HYDROFLAME"™ heat source. In other words, the ignition of the pressurized fuel and compressed air can create a suitable flame so that heat can be imparted to the cold seawater flowing through the pipe 50. As such, the temperature of the water flowing the pipe 50 can be significantly elevated within the chamber 42. The hot fluid exiting the chamber 52 through pipe 44 is delivered through the hot fluid inlet 18 of the heat storage box 12. The hot fluid will pass into the upper portion 28 of the interior volume 14 of the heat storage box 12. As will be described hereinafter, the pressurized fuel and the compressed air can be contained within tanks positioned on a skid. This skid can be located in a subsea location, along with the heat storage box 12. The heat storage box 12, along with skid supporting the pressurized fuel tank and the compressed air tank, can be located in the area adjacent to the hydrate formation. As such, heated fluid can be delivered from a convenient location for the purposes of remediating the hydrates.

The heat exchanger 20 includes piping 54 extending in a generally serpentine pattern within the upper portion 28 of the interior volume 14 of the heat storage box 12. The piping 54 defines a plurality of flow sections 56, 58, 60 and 62. The flow section 56 is located adjacent to the hot fluid inlet 18. As such, the temperature of the fluid within the interior volume 14 will be greatest in this location. The flow section 58 is located below flow section 56. Similarly, flow section 60 is located below flow section 58. Finally, flow section 62 is located below flow section 60. The descending order of these flow sections 56, 58, 60 and 62 allows one to control the temperature of the heated seawater passing outwardly of the heated water outlet 24. A manifold pipe 64 is connected to the flow sections 56, 58, 60 and 62 through respective valves 66, 68, 70 and 72. As such, the heated seawater can flow through the respective valves 66, 68, 70 and 72 to the manifold pipe 64 and then outwardly through the heated water outlet 24. For example, if a high temperature of heated seawater is required, then only valve 66 would be opened so that the hottest water will flow outwardly through the outlet 24. If greater volumes of heated seawater are required, then more than one of the valves 66, 68, 70 and 72 can be opened. As a result, the present invention allows for the modulation of the heat to the requirements of the particular hydrate formation. The cold seawater 74 is delivered to the piping 54 through the use of a pump 76. Pump 76 can suitably regulate the volume of water flowing through the piping 54 and, hence, outwardly through the heated water outlet 24. The flow of the cold seawater 74 through the serpentine pattern of the pipe 54 of heat exchanger 20 will assure maximum surface-to-surface contact with the hot fluid within the upper portion 28 of the interior volume 14 of the heat storage box 12. The piping 24 can be conventional copper tubing or, alternatively, other conductive material. The cooled fluid within the interior volume 14 will generally reside in and pass toward the lower portion 30 of the interior volume 14 and, eventually, outwardly through the cold water outlet 32.

The heated water outlet 24 is connected to line 22. Line 22 can be in the nature of a conduit, a hose, a flexible pipe, or other material, so as to allow the heated water to flow to a desired location.

In FIG. 1, it can be seen that the line 22 is connected to an inlet pipe 78 of a hot stab 80. The hot stab 80 is in the nature of a conventional "hot stab" as used in association with an ROV. A handle 82 extends outwardly of the hot stab 80 so as to allow the ROV to suitably manipulate the hot stab 80.

A hydrate remediation blanket 84 is shown as located in proximity to the hot stab 80. The hydrate remediation blanket 84 has an inlet 86 positioned so as to allow the hot stab 80 to be inserted thereinto by the ROV. The hydrate remediation blanket 84 includes a surface 88 extending downwardly from a tubular portion 90. As such, the heated water passing through the outlet 24, through the line 22 and through the hot stab 80, can be delivered through various orifices 92 along the surface of a hydrate remediation blanket 84. Since the surface 88 is suitable flexible, it can be placed over a desired location in a subsea location so that continual heat can be applied to the frozen hydrates that have been accumulated in this subsea location. A suitable sensor 94 is connected to the tubular portion 90 of the hydrate remediation blanket 84 so as to monitor the temperature of the heated water flowing therethrough.

The heating means 16 utilizes the compressed air and fuel. The air and fuel are supplied from a subsea skid-mounted tanks through a subsea umbilical. Once the fuel or air supply has been exhausted, the skid can be transported to the surface for reloading. Air is used to purge the seawater from the chamber 42 prior to the ignition of the heating means 16. Any gases will be exhausted from the upper portion 28 of the interior volume 14 of the heat storage box 12 through the vent 36. Cold water exits the interior volume 14 through the cold water outlet 32. The pump 76 is used to pump cold seawater into the heat exchanger 20 within the heat storage box 12. The valves 66, 68, 70 and 72 are used to obtain the desired temperature of the heated water. The heated water can be delivered in a variety of forms depending on the hydrate location. If a jumper or a pipeline is hydrated, the insulated hydrate remediation blanket 84 utilizing the perforated tubular member is used so as to deliver heat in a uniform method. If the manifold, tree, separator, or other mechanism has already been provided with a hydrate remediation circulation pad, the hot stab 80 can be directly connected to such hydrate remediation circulation pad so as to deliver the heat.

Figure 2:
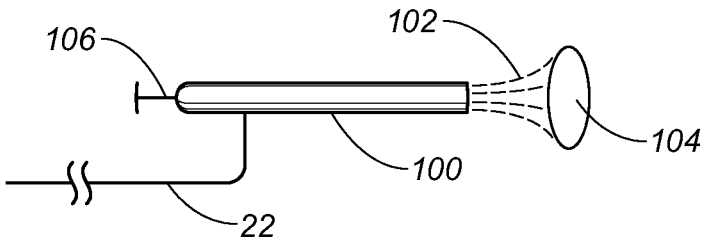
FIG. 2 is a side elevational view showing the use of the hydrate remdiation system of the present invention in connection with a wand.

FIG. 2 illustrates the use of a wand 100 for the delivery of heated water 102 to a difficult-to-reach space 104. It can be seen that the line 22 is connected to the wand 100 so as to deliver heated water thereinto. The wand 100 can have a suitable nozzle so as to cause the heated water 102 to be directed in a pressurized manner therefrom. A handle 106 is connected to the wand 100 so as to allow the ROV to properly manipulate the wand 100.

Figure 3:
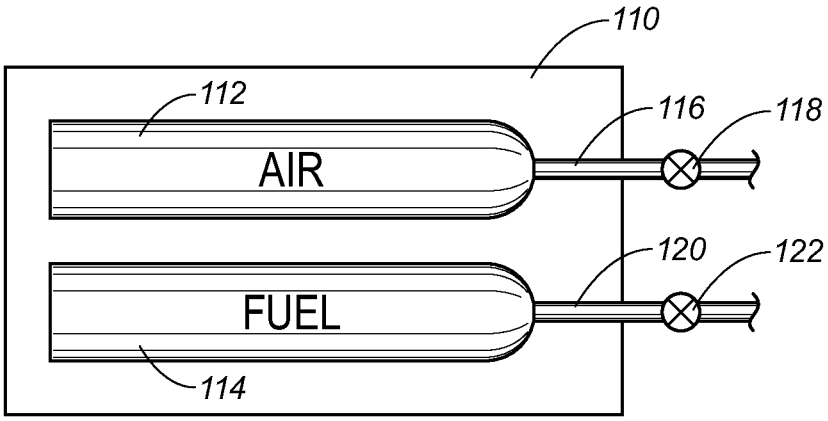
FIG. 3 is a plan view showing the positioning of the compressed air and pressurized fuel upon a skid located in a subsea location.

FIG. 3 shows a skid 110 having a compressed air tank 112 and a pressurized fuel tank 114 positioned thereon. A single skid 110 can be used or different skids can be used for the compressed air tank 112 and the pressurized fuel tank 114. A conduit 116 extends from the compressed air tank 112. Valve 118 is placed along the conduit 116 so as to control the flow of compressed air to the compressed air line 48. Similarly, a conduit 120 is connected to the pressurized fuel tank 114. Valve 122 is provided on the conduit 120 so as to control the release of the pressurized fuel from the fuel tank 114. As such, pressurized fuel can be delivered along conduit 120 to the pressurized fuel line 46.

In the present invention, the heat storage box 12 can be suitably lowered or delivered to a desired subsea location. The heat storage box 12 should be positioned in an area adjacent to the hydrate formation. The skid 10 can be suitably delivered, along with the heat storage box 12, to the desired location. As such, the present invention allows heated water to originate from an area where it can be conveniently used for the remediation of the hydrate formation. Heat can be delivered to the hydrates in a direct manner, such as through the wand 100 or in a distributed manner through the use of a hydrate remediation blanket 84. In the event that the fuel or the air tanks require replacements, the heat storage box is effective for storing heat during this period. The volume of the heat storage box allows the heat to be retained therein adjacent to the area of the hydrate formation.

The foregoing disclosure and description of the invention is illustrative and explanatory thereof. Various changes in the details of the illustrated construction or in the steps of the described method can be made within the scope of the appended claims without departing from the true spirit of the invention. The present invention should only be limited by the following claims and their legal equivalents.

We claim:

1. A system for remediating hydrates comprising:

a heat storage box having an interior volume with an upper portion and a lower portion, said heat storage box having a hot fluid inlet and a cold water outlet;

a heating means for heating fluid flowing into said hot fluid inlet;

a heat exchanger positioned in said interior volume of said heat storage box, said heat exchanger having a cold water inlet and a heated water outlet, said heat exchanger being in heat exchange relationship with heated water from said interior volume of said heat storage box; and a line connected to said heated water outlet of said heat exchanger, said line suitable for manipulation toward a location of the hydrates so as to deliver the heated water toward the hydrates, said heating means comprising:

a chamber having a water inlet and a heat source arranged such that said heat source elevates a temperature of the water in said chamber, said heat source being a mixture of pressurized fuel and compressed air and a means for igniting said mixture, the pressurized fuel being received within a first tank positioned on a skid, said compressed air being received with a second tank positioned on said skid, said first and second tanks connected to said chamber by conduits extending from said skid.

2. The system of claim 1, said heat exchanger being positioned in said upper portion of said heat storage box.

3. The system of claim 1, said heat storage box having insulated walls extending therearound.

4. The system of claim 1, said hot fluid inlet extending through a top of said heat storage box so as to open to said upper portion of said interior volume, said cold water outlet extending through a bottom of said heat storage box and opening to said lower portion of said heat storage box.

5. The system of claim 1, further comprising:

a gas vent extending through a wall of said heat storage box and having an end opening to said upper portion of said interior volume, said gas vent suitable for releasing a gas from said interior volume.

6. A system for remediating hydrates comprising:

a heat storage box having an interior volume with an upper portion and a lower portion, said heat storage box having a hot fluid inlet and a cold water outlet;

a heating means for heating fluid flowing into said hot fluid inlet;

a heat exchanger positioned in said interior volume of said heat storage box, said heat exchanger having a cold water inlet and a heated water outlet, said heat exchanger being in heat exchange relationship with heated water from said interior volume of said heat storage box; and a line connected to said heated water outlet of said heat exchanger, said line suitable for manipulation toward a location of the hydrates so as to deliver the heated water toward the hydrates, said heat exchanger comprising:

a piping extending in a serpentine pattern within said open portion of said interior volume, said piping defining a plurality of flow sections; and a manifold pipe communicating with said heated water outlet, said manifold pipe being connected by separate valve respectively to said plurality of flow sections of said piping.

7. The system of claim 6, said valves being selectively openable and closable, said valves arranged in vertically spaced relationship relative to each other within said interior volume of said heat storage box.

8. A system for remediating hydrates comprising:

a heat storage box having an interior volume with an upper portion and a lower portion, said heat storage box having a hot fluid inlet and a cold water outlet;

a heating means for heating fluid flowing into said hot fluid inlet;

a heat exchanger positioned in said interior volume of said heat storage box, said heat exchanger having a cold water inlet and a heated water outlet, said heat exchanger being in heat exchange relationship with heated water from said interior volume of said heat storage box;

a line connected to said heated water outlet of said heat exchanger, said line suitable for manipulation toward a location of the hydrates so as to deliver the heated water toward the hydrates;

a hot stab suitable for manipulation by an ROV, said hot stab connected to said line; and a hydrate mediation blanket having an inlet suitable for connection to said line so as to allow the heated water from said line to pass thereinto, said hydrate mediation blanket having a surface connected to said inlet so as to allow the heated water to be distributed along said surface.

9. The system of claim 8, said surface of said hydrate mediation blanket being suitably flexible so as to be positionable over an area requiring the hydrate remediation.

10. The system of claim 8, further comprising:

a wand connected to said line, said wand having an outlet suitable for allowing the heated water to be passed outwardly therefrom.

11. A process for remediating hydrates comprising:

heating cold water to an elevated temperature, the step of heating comprising:

mixing pressurized fuel and compressed air;

igniting the mixture of the pressurized fuel and compressed air; and passing seawater in heat exchange relationship with the ignited mixture;

passing the heated cold water into a heat storage box such that hot water or steam resides within an interior volume of said heat storage box;

delivering cold water through the hot water or steam in heat exchange relationship therewith so as to raise a temperature of the delivered cold water;

directing the raised temperature water to a desired location of the hydrates;

positioning heat exchange piping in an upper portion of said heat source box, said heat exchange piping defining a plurality of flow sections arranged in a generally stacked relationship;

connecting said plurality of flow sections separately through valves to a manifold pipe, said manifold pipe being connected to an outlet of said heat exchange piping; and selectively opening or closing the valves so as to allow the raised temperature water to flow to the desired location.

12. A process for remediating hydrates comprising:

heating cold water to an elevated temperature;

passing the heated cold water into a heat storage box such that hot water or steam resides within an interior volume of said heat storage box;

delivering cold water through the hot water or steam in heat exchange relationship therewith so as to raise a temperature of the delivered cold water; and directing the raised temperature water to a desired location of the hydrates, the step of directing comprising:

flowing the raised temperature water through a line connected to a hot stab;

manipulating said hot stab so as to move toward a hydrate remediation blanket;

connecting the hot stab to the hydrate remediation blanket; and introducing the raised temperature water into said hydrate remediation blanket so as to cause the raised temperature water to flow along a surface of said hydrate remediation blanket.

13. The process of claim 12, further comprising:

positioning the heat storage box in a subsea location.

14. A process for remediating hydrates comprising:

placing a tank of pressurized fuel on a skid;

placing a tank of compressed air on said skid;

lowering said skid to a subsea location;

heating cold water to an elevated temperature, the step of heating comprising:

mixing the pressurized fuel and the compressed air;

igniting the mixture of the pressurized fuel and the compressed air; and passing seawater in heat exchange relationship with the ignited mixture;

passing the heated cold water into a heat storage box such that hot water or steam resides within an interior volume of said heat storage box;

delivering cold water through the hot water or steam in heat exchange relationship therewith so as to raise a temperature of the delivered cold water; and directing the raised temperature water to a desired location of the hydrates.

* * * * *